US005246274A

United States Patent [19]

Smith et al.

[11] Patent Number: 5,246,274

[45] Date of Patent: Sep. 21, 1993

[54] REMOTE MINING HAULAGE SYSTEM WITH SELF-ADVANCING MOBILE TAILPIECE AND METHOD OF OPERATING SAME

[75] Inventors: Carl W. Smith, Charlottesville, Va.; Lawrence E. Meade, Jr., Kingsport, Tenn.

[73] Assignee: Amvest Corporation, Charlottesville, Va.

[21] Appl. No.: 893,545

[22] Filed: Jun. 4, 1992

[51] Int. Cl.[5] ..... B65G 21/10; E21C 35/20

[52] U.S. Cl. ..... 299/18; 198/594; 299/64

[58] Field of Search ..... 299/18, 64, 67, 56; 198/594, 812, 830, 861.2

[56] References Cited

U.S. PATENT DOCUMENTS

| | | | |
|---|---|---|---|
| Re. 31,622 | 7/1984 | Todd | 299/18 X |
| 4,003,602 | 1/1977 | Justice et al. | 299/18 |
| 4,082,362 | 4/1978 | Justice et al. | 299/57 |
| 4,118,072 | 10/1978 | Kelley et al. | 299/43 |
| 4,120,535 | 10/1978 | Delli-Gatti, Jr. | 299/18 |
| 4,256,213 | 3/1981 | Shaw et al. | 198/303 |
| 4,474,287 | 10/1984 | Thompson | 198/812 |
| 4,556,257 | 12/1985 | Justice et al. | 299/68 |
| 4,889,392 | 12/1989 | Justice et al. | 299/18 |
| 4,969,691 | 11/1990 | Moore et al. | 299/18 |
| 5,056,655 | 10/1991 | Justice | 299/56 X |

FOREIGN PATENT DOCUMENTS

| | | | |
|---|---|---|---|
| 1091512 | 10/1960 | Fed. Rep. of Germany | 198/861.2 |
| 3621274 | 1/1988 | Fed. Rep. of Germany . | |
| 695003 | 7/1953 | United Kingdom . | |

*Primary Examiner*—David J. Bagnell
*Attorney, Agent, or Firm*—Nixon & Vanderhye

[57] ABSTRACT

A haulage system and related process are provided for intermediate continuous conveying of coal or other mined minerals from the discharge of a continuous mining device to a distant point (typically outside the mine) where the mineral is stockpiled or transferred to another conveyor. The continuous haulage device of this invention is able to advance behind the continuous miner without interruptions for repositioning, and to follow the continuous miner without intervention, as it proceeds into the mine entry and beyond. The subject haulage system is not mechanically coupled to the miner and does not rely on the miner for its locomotive power. The receiving end of the haulage system maintains its position beneath the miner discharge by means of a mechanical proximity sensor, which enables the system to mimic the irregular pattern of advancement typical of continuous mining systems.

25 Claims, 6 Drawing Sheets

REMOTE MINING HAULAGE SYSTEM WITH SELF-ADVANCING MOBILE TAILPIECE AND METHOD OF OPERATING SAME

This invention relates generally to automated mining equipment operated by remote control and, more specifically, to a continuous haulage device which automatically tracks a continuous miner to thereby maintain a required recovery position beneath the miner discharge.

BACKGROUND AND SUMMARY OF THE INVENTION

Advances in automated mining equipment now enable continuous coal mining devices to be operated by remote control, with a human operator located a safe distance from the mining face and from the mining machinery. One limitation on the ability to continue remote control mining deep into a mineral seam is the need to provide some means for removing the mined material as it is discharged from the miner. Various types of continuous haulage devices have been developed for this purpose, each with its own shortcomings. Representative examples of haulage systems are disclosed in U.S. Pat. Nos. 4,969,691; 4,474,287; 4,256,213; and 4,120,535. There continues to be a need, however, for a continuous haulage device which has the ability to automatically track a continuous miner as it proceeds into the seam, while maintaining the required recovery position beneath the miner discharge.

It is therefore the principle object of this invention to provide a system for intermediate continuous conveying of coal or other mined minerals from the discharge of a continuous mining device to a distant point where the mineral is stockpiled or transferred to another conveyor. The continuous haulage device of this invention is able to advance behind the continuous miner without interruptions for repositioning, and to follow the continuous miner without intervention, as it proceeds into the mine entry and beyond. Significantly, the subject haulage system is not mechanically coupled to the miner and does not rely on the miner for its locomotive power. The receiving end of the haulage system maintains its position beneath the miner discharge by means of a mechanical proximity sensor, which enables the system to mimic the irregular pattern of advancement typical of continuous mining systems.

In one exemplary embodiment, the haulage system of this invention is comprised of a continuous, flexible (preferably rubber) conveyor belt of sufficient length to extend from the mine entry to a mobile belt conveyor tailpiece assembly which follows the continuous miner. The system also includes insertable conveyor support roller cars which are added behind the mobile tailpiece as the conveyor is extended into the mine. A belt storage/feed device and tensioning device are located on the outby end of the conveyor and can be of any suitable conventional design.

The mobile tailpiece assembly serves as the receiving end of the conveyor, and may also include a feeder/-breaker if desired. Its location must be maintained relative to the miner discharge end to enable the miner to operate continuously. The tailpiece assembly is mounted on electrically or hydraulically powered crawlers which are used primarily for alignment of the tailpiece with the miner as described below.

The support cars are of rigid construction with a cantilevered top roller assembly, allowing them to be inserted laterally into the moving conveyor belt. Each car is rigidly connected to the other by a "spine" structure along the centerline axis. Cars are supported by freely rotating tired wheels. Once connected, the cars are pulled into the drift by the advancing mobile tailpiece. The first car is connected to the trailing section of the mobile tailpiece by a wire rope or ropes passing through a sheave(s) mounted on the tailing section of the mobile tailpiece. The wire rope(s) return to the outby in a channel(s) provided on the conveyor roller support cars.

As the miner proceeds into a mine drift or seam, the mobile conveyor tailpiece follows, thus extending the conveyor belt. The insertable conveyor support roller cars are installed in the "free space" between the tailpiece (or the last car), and an outby support pulley (and associated winch). The cars are of rigid construction with a cantilevered top roller assembly, allowing them to be inserted laterally into the moving conveyor belt. Each car is rigidly connected to the other by a "spine" structure along the center line axis of each car. The cars are supported by freely rotating wheels (preferably with pneumatic tires) and, once connected, the cars are pulled into the mine drift by a unique cable arrangement described below. The first car is connected to the trailing section of the mobile tailpiece by one or more cables or wire ropes passing through sheaves mounted on the trailing section of the mobile tail piece. The wire rope or ropes return to the powered winch at the outby via a channel or channels provided on the conveyor roller support cars.

The mobile tailpiece crawlers do not have the tractive power to not only maintain the desired location behind the continuous miner, but also to provide the motive force for the belt roller support cars. Rather, the mobile tailpiece is only required to advance itself and to overcome the belt tension arising from the pulling of extended sections of the conveyor belt into the mine from the belt storage assembly. The mobile tailpiece is also equipped with two pairs of fixating hydraulic jacks, one pair at each of the forward and rearward ends of the tailpiece. Each jack is comprised of a double acting hydraulic cylinder which, when actuated, anchors the tailpiece between the roof and floor of the mine.

Upon advancing a predetermined distance beyond the anchored mobile tailpiece, a proximity sensor indicates the need for the mobile tailpiece and conveyor to follow. The fixating jacks on the mobile tailpiece are withdrawn, and the cable or cables relaxed to provide slack, thereby allowing the tailpiece to advance on its crawlers to align itself properly beneath the miner discharge, i.e., in overlying relationship. When the tailpiece is advanced the desired distance, the fixating jacks are actuated, again anchoring the tailpiece in place. Tension is then applied to the cable from the winch, thus advancing the conveyor support roller car train toward the tailpiece. When the single drift has been completed, the conveyor support roller cars are extracted by disconnecting the cable from the first car and pulling from the outby.

Thus, in one aspect, the present invention relates to a remote mining, continuous haulage system including a continuous miner, a mobile tailpiece assembly having a self-contained drive, said mobile tailpiece assembly adapted to receive mined material from the miner, and a plurality of conveyor support cars trailing the tailpiece assembly, the improvement comprising: means independent of the mobile tailpiece drive for pulling the plurality of conveyor support cars into the mine behind the mobile tailpiece.

In another aspect, the invention relates to a method of continuously operating a remote mining haulage system which comprises a continuous miner having a cutting head at a forward end and a discharge assembly at a rearward end; a mobile tailpiece carrying a forward end of an endless conveyor, the mobile tailpiece including means for anchoring the tailpiece within a mine, and further including at least one pulley mounted on a rearward end thereof; and a plurality of conveyor roller support cars extending behind the mobile tailpiece the method comprising the steps, in sequence, of:

a) advancing the miner into a mine drift while the mobile tailpiece is anchored in place within the mine;

b) upon the miner advancing a predetermined distance beyond the mobile tailpiece, releasing the mobile tailpiece;

c) advancing the mobile tailpiece to maintain the discharge end of the miner and the forward end of the continuous conveyor in alignment while the support cars remain stationary, and to introduce additional conveyor sections into the mine;

d) anchoring the mobile tailpiece;

e) advancing the plurality of conveyor support cars toward the mobile tailpiece by a flexible member controlled by a tension device outside the mine; and f) adding additional conveyor support vehicles behind a last of the vehicles as required by extension of the conveyor belt.

The description of the invention above is based on its use with a drum type continuous miner in a drift mining installation. It will be understood, however, that the invention is not limited to this application, and may be installed with many continuous miner designs in various mining situations.

Other objects and advantages of the present invention will become apparent from the detailed description which follows.

DETAILED DESCRIPTION OF THE DRAWINGS

Figure 1:
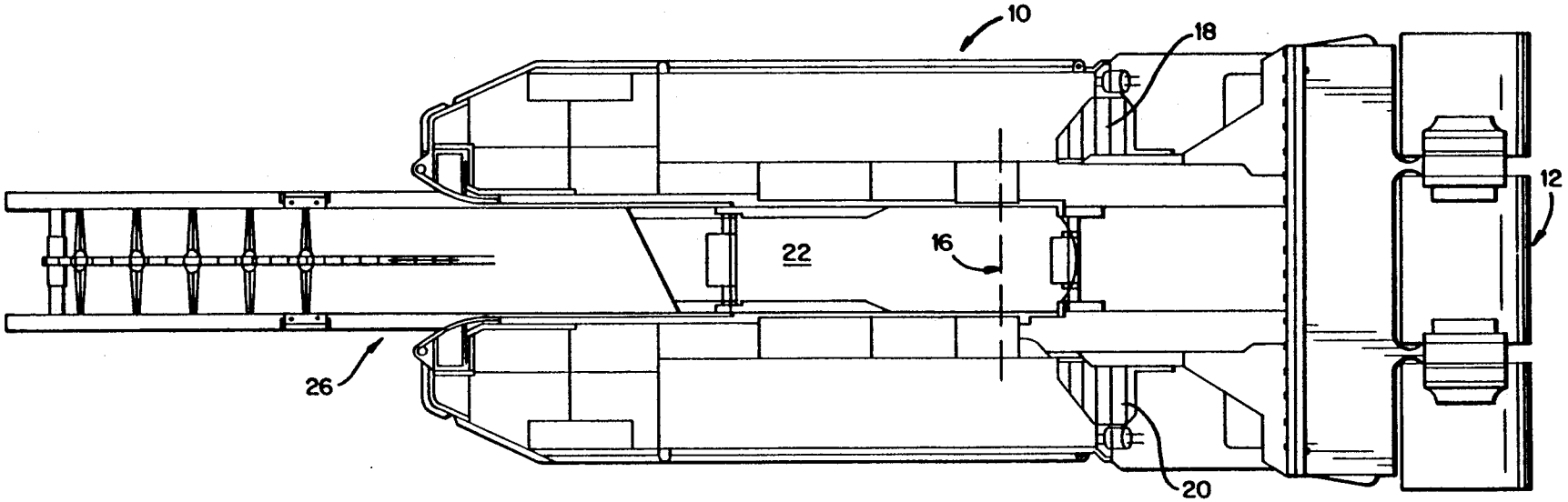
FIG. 1 (PRIOR ART)
FIG. 1 is a top view of a conventional continuous miner suitable for use in the invention.
Figure 2:
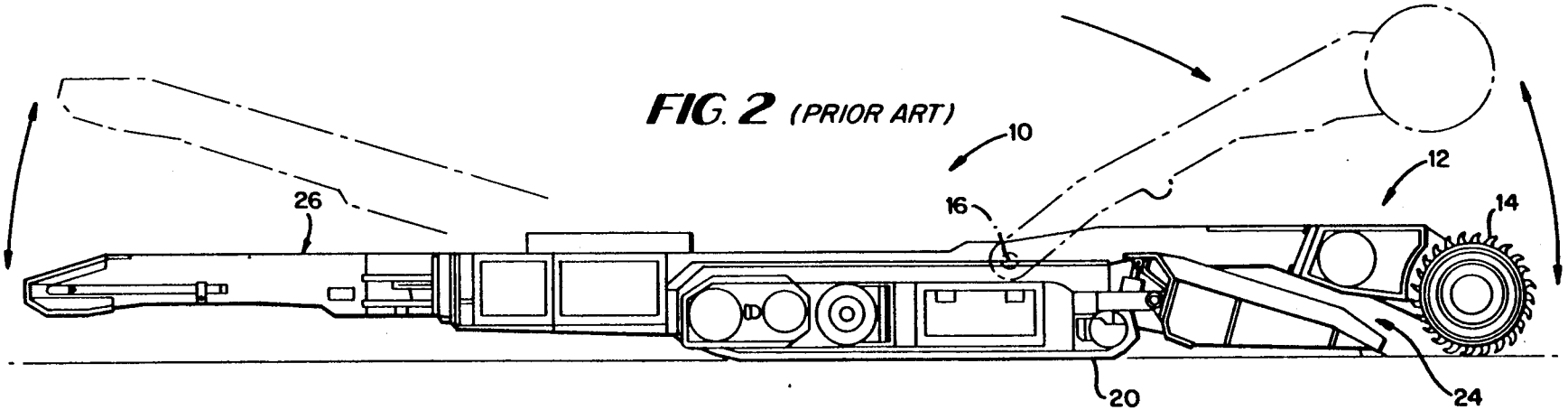
FIG. 2 (PRIOR ART)
FIG. 2 is a side view of the miner illustrated in FIG. 1 illustrating in phantom the pivotal mounting arrangement of the rotary cutting head at the forward end of the miner, and the conveyor discharge assembly at the rearward end of the miner.

With reference to FIG. 1, a conventional continuous miner 10 is illustrated and includes a rotary cutting head 12 provided with conventional cutters 14, the head pivotally mounted for reciprocatory movement about a horizontal axis or pivot 16. The miner 10 is self-powered, and is provided with tracks or crawlers 18, 20 for effecting movement into the seam. The miner 10 is also provided with a self-contained conveyor 22 which receives coal from an inlet 24 and which moves the coal rearwardly to a discharge assembly 26 which is also pivotally mounted to the main body of the miner so as to facilitate the continuous haulage of coal from the mine as described in greater detail below.

The miner 10 as described above forms no part of the invention per se. It may be of conventional construction, and of the type available from manufacturers such as Joy Technologies Inc., and Eimco. As such, the details of the miner construction need not be described in any further detail.

Figure 3:
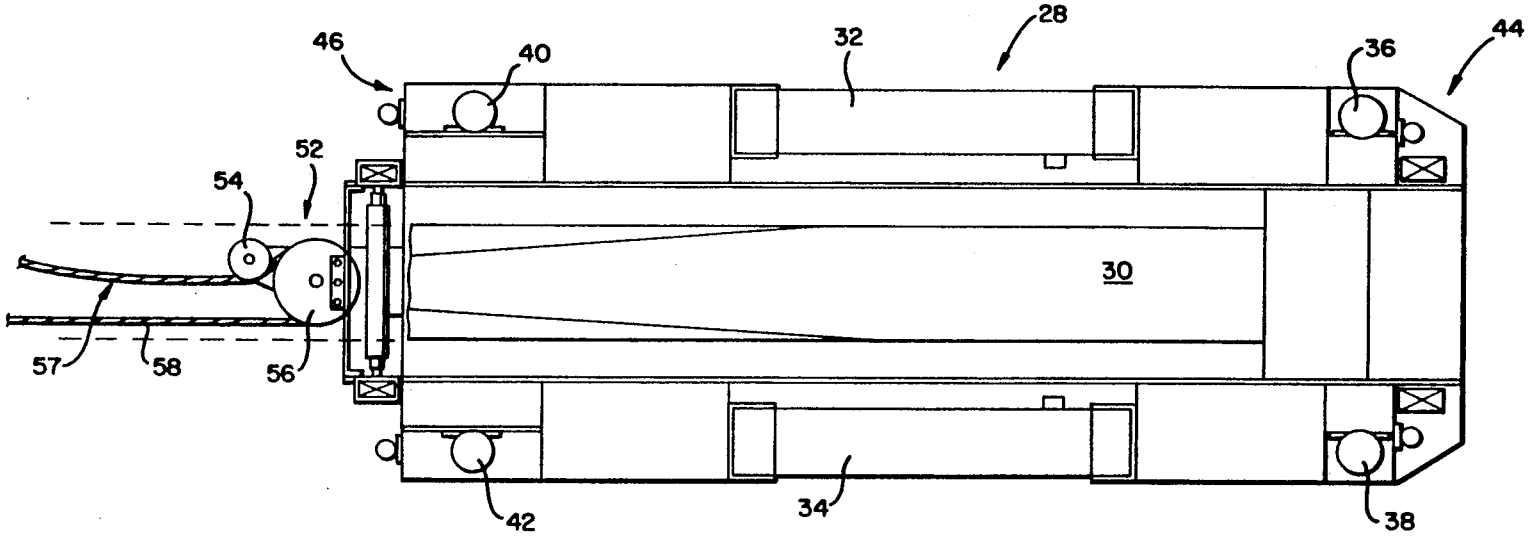
FIG. 3 is a top view of a mobile conveyor tailpiece in accordance with the invention.
Figure 4:
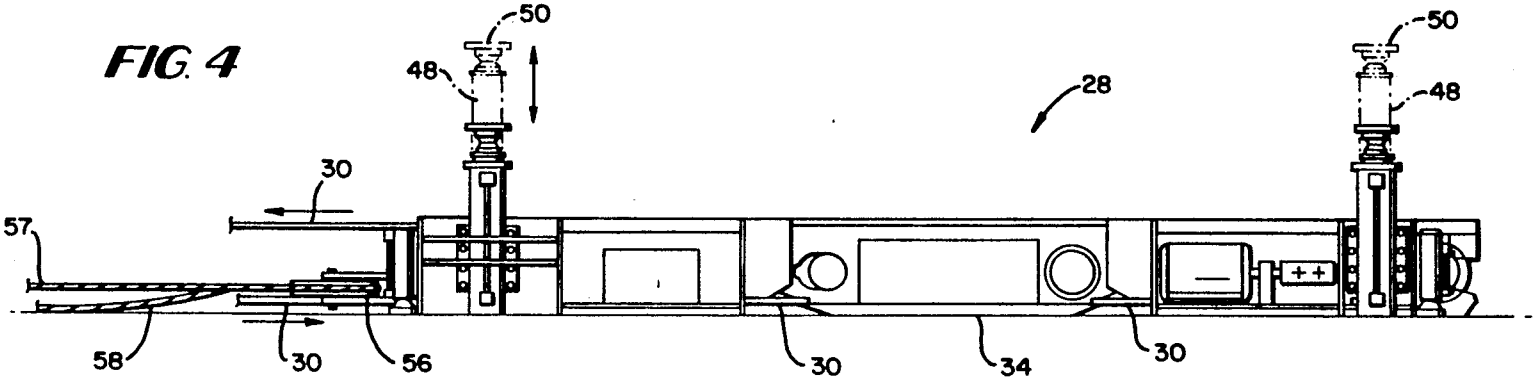
FIG. 4 is a side view of the mobile conveyor tailpiece illustrated in FIG. 3.

Turning to FIGS. 3 and 4, a mobile conveyor tailpiece 28 is illustrated which is designed to carry the forward end of a continuous haulage system and to locate that forward end in the appropriate position relative to the discharge assembly 26 of the miner 10.

As noted above, the mobile tailpiece 28 carries the forward end of an endless conveyor belt 30 in a well known manner. The tailpiece is self-powered, moving forward on crawlers or tracks 32, 34. The tailpiece is also fitted with jacks 36, 38, 40, 42, two each located at forward and rearward ends 44, 46, respectively, of the tailpiece.

Each jack comprises a vertically oriented double acting hydraulic cylinder 48, the piston of which has a plate or pad 50 at its free end which is adapted to engage the mine roof when extended, as described in further detail below.

The tailpiece 28 is also provided at its rearward end 46 with a pulley assembly 52 including grooved rollers 54, 56 mounted horizontally for rotation about vertical axes. The pulley assembly receives a cable 57, one end portion 58 of which is attached to an adjacent support car (described below). The cable extends toward the mobile tailpiece, passes about the rollers 54, 56 and extends rearwardly to a powered winch W located outside the mine, as also described below.

As in the case of the miner 10, the tailpiece construction is of generally conventional construction, and may be of the type available, for example, from Mecco-Owens Corp. The sheave/cable assembly 52, 57 and the manner in which the tailpiece 28 interacts with the support cars to provide continuous haulage, however, is new to this invention.

Figure 5:
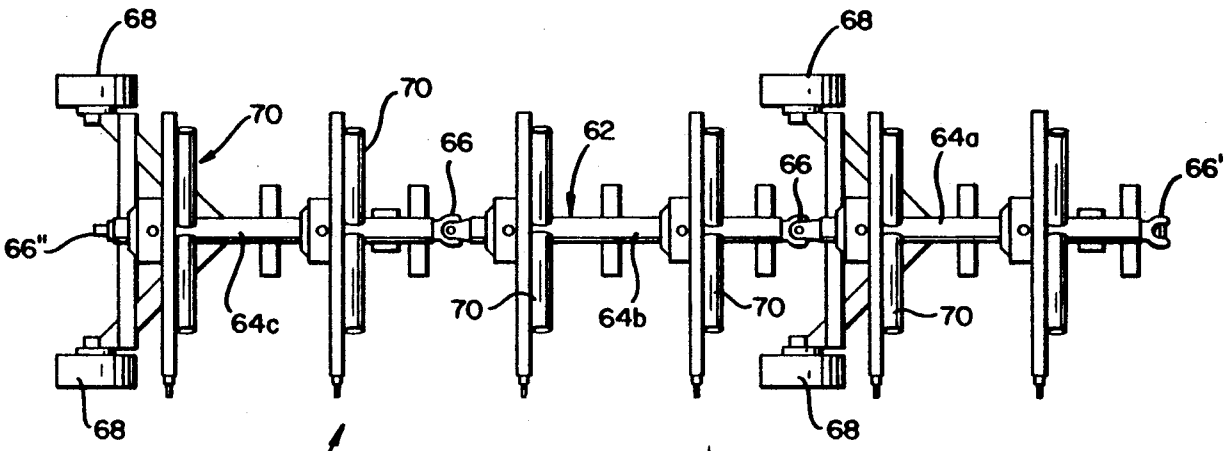
FIG. 5 is a top view of a support car suitable for use in the subject invention.
Figure 6:
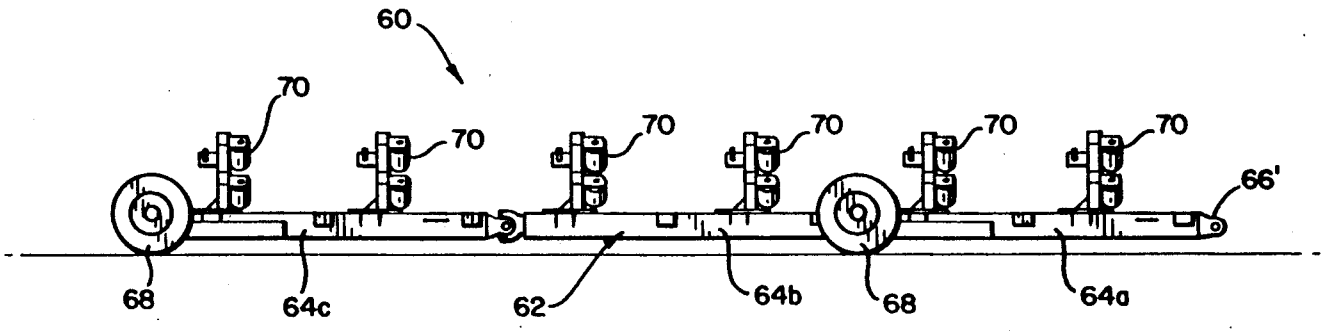
FIG. 6 is a side view of the support car illustrated in FIG. 5.

Referring now to FIGS. 5 and 6, an exemplary support car 60 is a rigid, longitudinally, oriented structural spine 62 which comprises a plurality of segments 64*a*, 64*b* and 64*c* connected by mechanical coupler assemblies 66. The couplers 66 are particularly useful in that they allow the support cars to be introduced into the haulage system outside the mine from a position laterally offset from the conventional conveyor storage/-feed assembly. See FIG. 8 where a group of cars 60 is shown schematically (and not to scale vis-a-vis car 60 in the mine) to one side of the mine entry. In other words, the cars may be required to turn in segments as they are introduced into the conveyor system and, as each car aligns itself with the car immediately forward. Upon reaching a position where all of the segments 64*a, b* and *c* of a given car are in longitudinal alignment, the coupler assemblies 66 may be locked to thereafter maintain the spine 62 rigid.

It will be appreciated that the forward coupler component 66' is adapted to engage a complimentary coupler on the rearward end of the car in front of car 60, while the rearward coupler component 66' of car 60 is adapted to receive a forward coupler of a next introduced car.

Cars 60 are supported on freely rotatable wheels 68 which are preferably of the pneumatic, rubber tire type. The cars 60 are also each provided with a plurality of conveyor support roller assemblies 70 which are preferably supported in a cantilevered manner so as to allow the cars to be inserted laterally into the moving, endless conveyor belt. Roller assemblies 70 are arranged to cause the belt 30 to assume a trough shape to thereby aid in retaining mined coal on the belt.

The aforementioned cable 57 passes along a longitudinally arranged channel (not shown) in each car, as it extends from the first car, around the sheave assembly 52 on the tailpiece 28 and back along each car 60 to the powered winch W outside the mine.

Having described each of the principal components of the continuous mining system in accordance with this invention, the manner in which the system operates within a seam 72 will now be described with reference to FIGS. 7 through 11.

At the outset, as the miner 10 moves into the seam 72, as defined by sidewalls 74, 76, and mines coal at the forward wall 78 in the usual manner, the mined coal 80 will be fed onto the belt 22 of the miner 10 via inlet 24.

Figure 7:
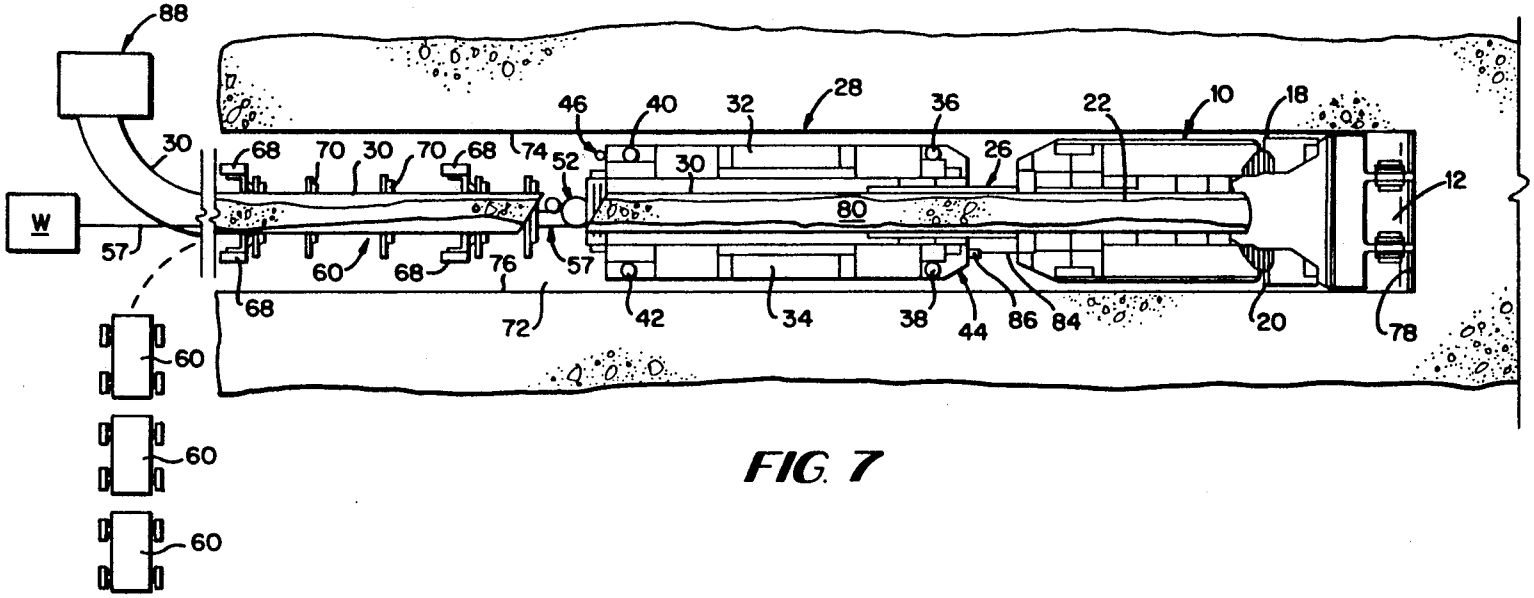
FIG. 7 is a partial top view of a continuous miner, mobile tailpiece and support car within a coal mine seam.
Figure 8:
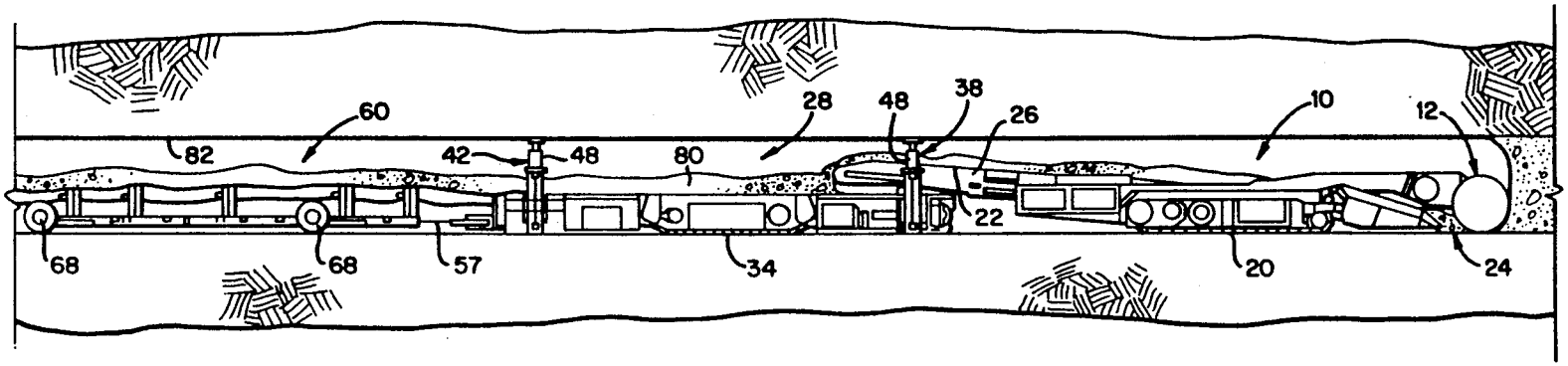
FIG. 8 is a side view of the arrangement illustrated in FIG. 7.
Figure 9:
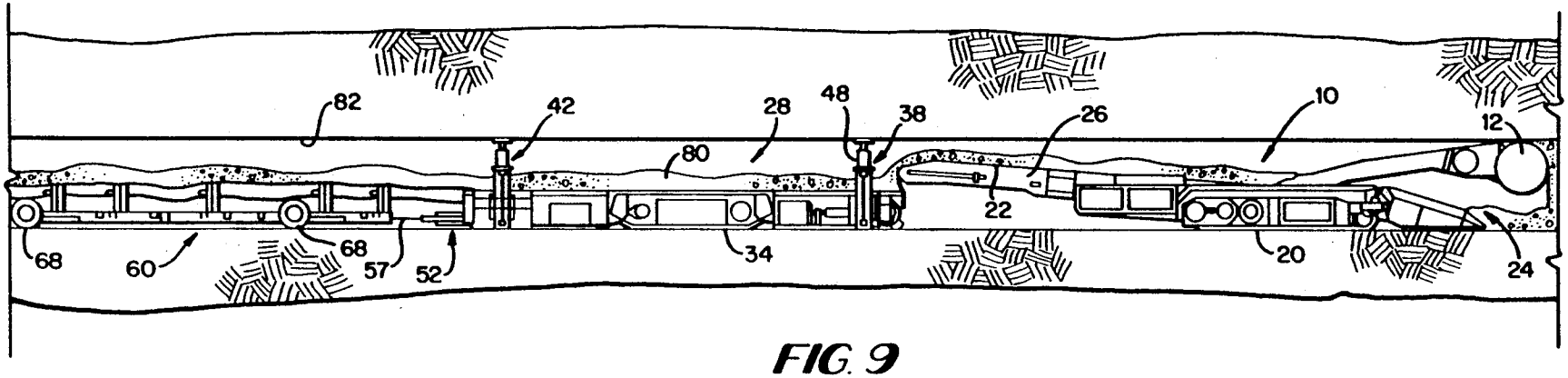
FIGS. 9, 10 and 11 are side views similar to FIG. 8 but illustrating the sequence of movement of the continuous miner relative to the mobile tailpiece and support cars in accordance with a preferred embodiment of the invention.

The mobile tailpiece 28 must remain within a predetermined distance of the miner 10 as defined primarily by the distance by which discharge assembly 26 extends behind the miner 10. As shown in FIGS. 7 and 8, the discharge assembly 26 overlaps with the forward end 44 of the tailpiece 28 so that mined coal 80 will be discharged from conveyor 22 onto conveyor 30 which, in turn, will carry the mined coal out of the mine, to another conveyor or to other transport means (not shown). It will be appreciated that the pivot-mounting of the discharge assembly permits adjustment relative to the mobile tailpiece.

Again, as shown in FIG. 8, the miner 10 is mining the forward wall 78 of the seam, while tailpiece 28 is firmly anchored in place by jacks 36, 38, 40 and 42, the pads or plates 50 of which are engaged with the mine roof 82.

It will be appreciated from the above description, that as the continuous miner 10 progresses forwardly into the seam, there will come a time when it is necessary to move the mobile conveyor tailpiece assembly 28 forward in order to maintain alignment under the discharge assembly 26 of the continuous miner. The point at which the mobile tailpiece needs to be moved forward to maintain its alignment with the continuous miner can be controlled by a conventional proximity sensor which may take the form of a reel and cable system extending between the continuous miner and the mobile tailpiece. For example, as shown in FIG. 7 (only), a cable 84 may be paid out from a reel 86 on the mobile tailpiece, with the forward end of the cable being attached to the continuous miner 10. Upon payout of a predetermined length of cable 84, a conventional sensor (not shown) will activate the mobile tailpiece controls to retract the pistons of the jacks 36, 38, 40 and 42 and to actuate the drive of the mobile tailpiece 28 to thereby move the mobile tailpiece 28 forward and under the discharge assembly 26 to the position as illustrated in FIG. 10.

During the forward movement of the tailpiece assembly 26, the winch W provides slack in the cable 57 between the sheave assembly 52 and the winch W so that the support cars remain stationary, i.e., the mobile tailpiece 28 is not required to drag all of the following support cars 60 with it as it moves forward to maintain its alignment with the continuous miner 10. As a result, the drive of the mobile tailpiece need only have sufficient power to move the tailpiece itself and pull additional conveyor belt material from the conveyor belt storage facility 88 outside the mine.

Figure 10:
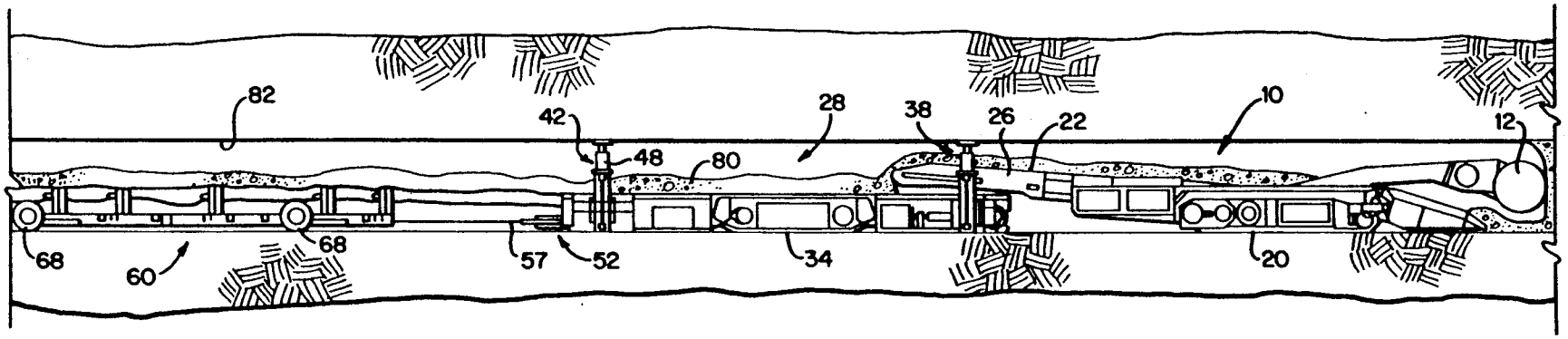
Figure 11:
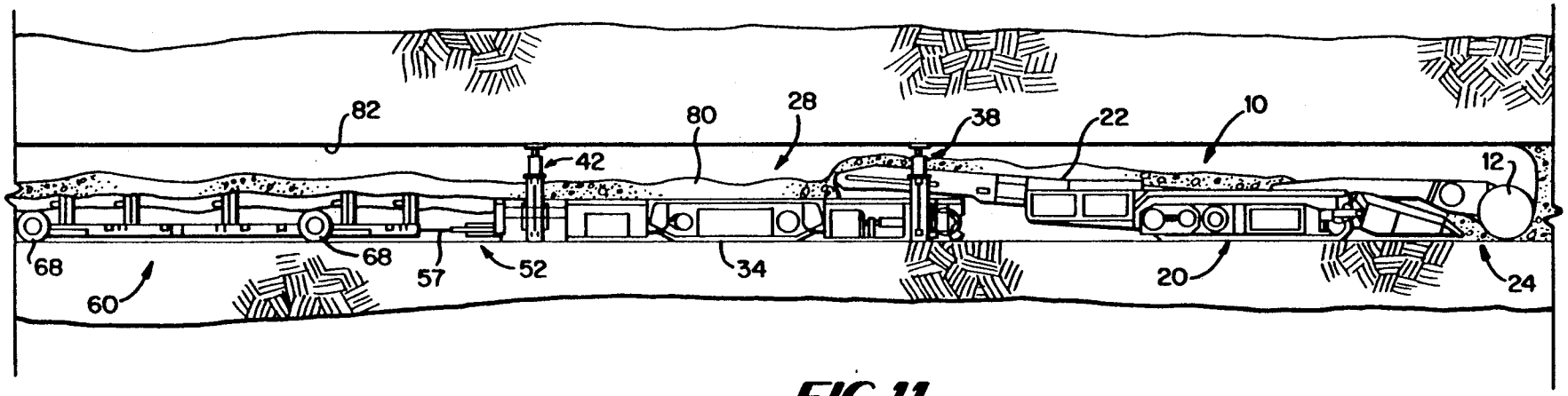

After the mobile tailpiece has been moved to the position illustrated in FIG. 10, the jacks 36, 38, 40 and 42 are again actuated so that the pistons of the double acting cylinders 48 are extended into engagement with the mine roof to thereby firmly anchor the mobile tailpiece 28. At this point, the winch W is actuated to tension the cable 57, thereby pulling all of the support cars 60 into close proximity with the mobile tailpiece as seen in FIG. 11. As necessary, additional cars 60 are brought in to support the newly introduced conveyor sections (see FIG. 7), and connected via coupler 66' to a mating coupler 66'' on the car immediately ahead. The feeding of cars into the mine can be done manually or by other suitable means. This sequence is repeated as necessary during the mining operation.

Upon completion of the mining operation, the conveyor support roller cars may be extracted from the entry end of the mine simply by pulling from the outby.

By so arranging the continuous haulage system, less expensive mobile tailpiece crawlers can be employed since it is not required that they have tractive power sufficient to maintain its own location behind the continuous miner as well as to provide the motive force for the belt roller support cars. Moreover, since the support cars themselves are non-powered, typical problems relating to individually powered support cars are also eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a remote mining continuous haulage system including a continuous miner, a mobile tailpiece assembly having a self-contained drive, said mobile tailpiece assembly adapted to receive mined material from said miner, and a plurality of conveyor support cars trailing said tailpiece assembly, the improvement comprising:

means independent of said mobile tailpiece drive for pulling said plurality of conveyor support cars into the mine in a first direction behind said mobile tailpiece through the application of a pulling force in a second direction opposite said first direction.

2. The improvement of claim 1 wherein said means includes a winch outside said mine, a pulley on said tailpiece, and a cable extending between a first support car behind the mobile tailpiece, toward and around the pulley, and back along said plurality of conveyor support cars to said winch.

3. A remote mining continuous haulage system comprising:

a continuous miner having a cutting head at a forward end and a discharge assembly at a rearward end;

a mobile tailpiece carrying a forward end of an endless conveyor, said tailpiece including means for anchoring the tailpiece within a mine, and further including at least one pulley mounted on a rearward end thereof;

a plurality of conveyor roller support cars extending behind said mobile tailpiece; and a cable extending from the roller support car immediately behind said mobile tailpiece in a first direction toward said mobile tailpiece, around said pulley and thereafter in a second direction opposite said first direction to a cable tension device located outside the mine.

4. The system of claim 3 wherein said means for anchoring comprise a plurality of jacks.

5. The system of claim 4 wherein each jack comprises a double acting hydraulic cylinder and piston assembly.

6. The system of claim 3 wherein each roller support car is supported by a plurality of freely rotatable wheels.

7. The system of claim 3 wherein each roller car comprises a plurality of articulatable and lockable segments.

8. The system of claim 3 wherein each roller car mounts a plurality of conveyor belt support rollers.

9. The system of claim 3 and further comprising a proximity sensor to determine linear distance between said miner and said tailpiece.

10. A haulage system for a continuous mining operation comprising:

a continuous miner having a first conveying portion;

a mobile tailpiece having a self-contained drive and second conveying portion adapted to receive mined material from said first mining portion;

a plurality of cars supporting a third conveying portion extending from said tailpiece to an entry to the mine; and means located outside said mine entry and including a cable attached at one end to a first car located immediately behind said tailpiece, and at a second end to said means, for advancing said plurality of cars into the mine independent of the mobile tailpiece drive.

11. The system of claim 10 and including a pulley assembly mounted on said tailpiece and adapted to receive said cable intermediate said first and second ends.

12. The system of claim 11 wherein said support cars are non-powered.

13. The system of claim 12 wherein said tailpiece is provided with means for anchoring said tailpiece against linear movement within the mine.

14. A remote mining haulage system comprising:

a continuous miner having a forward working end and a rearward discharge end;

a self-advancing mobile tailpiece having first drive means for advancing said tailpiece to maintain alignment with said discharge end of said miner, said mobile tailpiece mounting a forward end of a continuous conveyor belt;

a plurality of non-powered conveyor support vehicles connected to said mobile tailpiece and supporting intermediate portions of said conveyor belt;

sensing means for controlling movement of said mobile tailpiece relative to said miner to maintain alignment of said forward end of said conveyor belt with said rearward discharge end; and second drive means independent of said first drive means for pulling said support vehicles into the mine behind said mobile tailpiece.

15. The system of claim 14 wherein said second drive means is locatable outside the mine.

16. The system of claim 15 wherein said first drive comprises electrically or hydraulically powered crawlers.

17. The system of claim 14 wherein said plurality of conveyor support vehicles are supported on freely rotatable wheels.

18. The system of claim 14 wherein said mobile tailpiece is provided with a plurality of jack mechanisms adapted to rigidly fix said mobile tailpiece in place in the mine.

19. The system of claim 14 wherein said plurality of conveyor support vehicles are rigidly connected to each other.

20. The system of claim 14 wherein said second drive means includes cable means extending from said a support vehicle behind said tailpiece, through a pulley on said mobile tailpiece, and through each of said conveyor support vehicles to a powered winch at the mine entry.

21. A method of continuously operating a remote mining haulage system which comprises a continuous miner having a cutting head at a forward end and a discharge assembly at a rearward end; a mobile tailpiece carrying a forward end of an endless conveyor, said mobile tailpiece including means for anchoring the tailpiece within a mine, and further including at least one pulley mounted on a rearward end thereof; and a plurality of conveyor roller support cars extending behind said mobile tailpiece the method comprising the steps, in sequence, of:

a) advancing the miner into a mine drift while said mobile tailpiece is anchored in place within the mine;

b) upon said miner advancing a predetermined distance beyond said mobile tailpiece, releasing the mobile tailpiece;

c) advancing the mobile tailpiece to maintain the discharge end of the miner and the forward end of the continuous conveyor in alignment while the support cars remain stationary, and to introduce additional conveyor sections into the mine;

d) anchoring the mobile tailpiece;

e) advancing the plurality of conveyor support cars toward said mobile tailpiece by a flexible member controlled by a tension device outside the mine; and f) adding additional conveyor support vehicles behind a last of said vehicles as required by the introduction of said additional conveyor sections.

22. The method of claim 21 wherein during step c), slack is provided in said flexible member, and wherein during step e) tension is applied to said flexible member.

23. The method of claim 21 wherein said continuous miner and said mobile tailpiece are self-powered.

24. The method of claim 21 wherein step d) is carried out by extending pistons of a plurality of vertically arranged hydraulic cylinders mounted on said mobile tailpiece.

25. The method of claim 21 and including repeating steps a) through e).

* * * * *